US006487757B1

(12) United States Patent
Stubler et al.

(10) Patent No.: US 6,487,757 B1
(45) Date of Patent: Dec. 3, 2002

(54) SYSTEM FOR CONNECTING A STRUCTURAL CABLE TO A BUILDING WORK STRUCTURE

(75) Inventors: Jérôme Stubler, Paris (FR); René-Louis Geffroy, Meudon-La-Foret (FR)

(73) Assignee: Freyssinet International (STUP) (FR)

( * ) Notice: Subject to any disclaimer, the term of this patent is extended or adjusted under 35 U.S.C. 154(b) by 0 days.

(21) Appl. No.: 09/831,841

(22) PCT Filed: Sep. 12, 2000

(86) PCT No.: PCT/FR00/02513

§ 371 (c)(1),
(2), (4) Date: May 15, 2001

(87) PCT Pub. No.: WO01/20081

PCT Pub. Date: Mar. 22, 2001

(30) Foreign Application Priority Data

Sep. 15, 1999 (FR) ..... 99 11516

(51) Int. Cl.[7] ..... E04C 5/12; F16B 11/04; F16B 1/20

(52) U.S. Cl. ..... 24/122.6; 24/115 M; 24/136 R

(58) Field of Search ..... 24/136 R, 115 M, 24/122.6

(56) References Cited

U.S. PATENT DOCUMENTS

| | | | | | |
|---|---|---|---|---|---|
| 3,698,749 | A | | 10/1972 | Yonkers | |
| 3,952,377 | A | * | 4/1976 | Morell | 24/136 R |
| 3,975,799 | A | * | 8/1976 | Kerr | 24/122.6 |
| 4,367,568 | A | * | 1/1983 | Weiser | 24/122.6 |
| 4,744,691 | A | * | 5/1988 | Thal | 24/136 R |
| 5,233,730 | A | * | 8/1993 | Milne et al. | 24/136 R |
| 5,713,169 | A | | 2/1998 | Meier et al. | |

FOREIGN PATENT DOCUMENTS

| | | |
|---|---|---|
| EP | 0 554 161 | 8/1993 |
| FR | 2 069 424 | 9/1971 |
| FR | 2 685 406 | 6/1993 |
| FR | 2 708 017 | 1/1995 |
| GB | 2 245 287 | 2/1992 |

* cited by examiner

*Primary Examiner*—Victor Sakran
(74) *Attorney, Agent, or Firm*—Cantor Colburn LLP

(57) ABSTRACT

A connecting system for connecting a cable including at least one wire for a building work structure and an element of the structure. The connecting system comprises a clamping device which is connected to the element of the structure, and a load transmitting device which transmits a clamping load of the clamping device to the cable and which houses the at least one wire of the cable. The at least one wire is bonded into the load transmitting device.

12 Claims, 3 Drawing Sheets

FIG. 5.
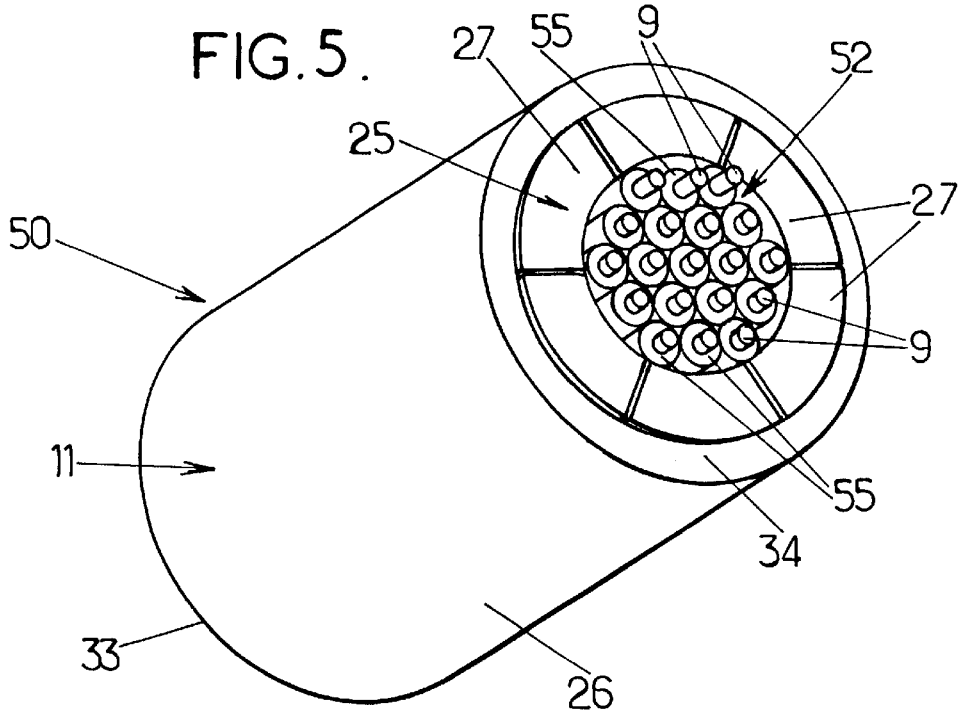
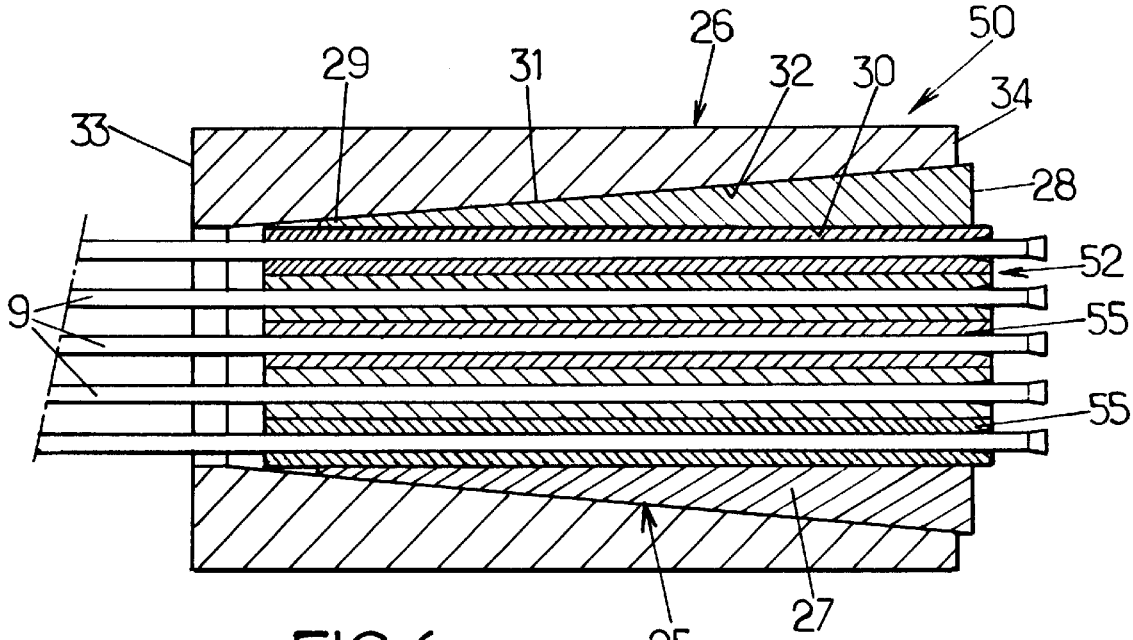
FIG. 6.

SYSTEM FOR CONNECTING A STRUCTURAL CABLE TO A BUILDING WORK STRUCTURE

FIELD OF INVENTION

The present invention relates to a connecting system for connecting a cable for a building work structure and an element of this structure, the cable comprising at least one wire.

The present invention relates in particular to cables made up of a certain number of strands themselves combining several wires, which are stressed particularly in tension in building work structures Such as offshore platforms of the tension-leg type, or suspension or cable stayed bridges.

DESCRIPTION OF RELATED ART

Connecting systems are needed to anchor the cables, for example, in the sea bed. These systems are not always easy to access, which makes them expensive to install.

SUMMARY OF THE INVENTION

It is an object of the invention to provide a connecting system in which the wires are firmly anchored to withstand in particular tensile loadings and to do so using means which are simple, effective and inexpensive.

To this end, according to the invention, a connecting system of the kind in question is essentially characterized in that it comprises:

- a clamping device which is connected to the structure element, and
- a load transmitting device which transmits the clamping loads of the clamping device to the cable and which houses said at least one wire of the cable, and in that said at least one wire is bonded into the load transmitting device.

Thus, by virtue of these provisions, each wire of the cable is firmly and simply held when this wire is tensioned.

In preferred embodiments of the reinforcement according to the invention, recourse is further had to one and/or another of the following provisions:

- the clamping device comprises at least two keys of a jaw assembly, which bear against the load transmitting device and means for compressing the jaw assembly;
- the compressing means comprise a sleeve, the interior wall of which converges toward one end of the sleeve, the keys of the jaw assembly being of a shape that complements that of said interior wall and being mounted in the sleeve so that they can be clamped in the sleeve by a wedge effect;
- the keys have an approximately triangular longitudinal cross section;
- the transmitting device comprises at least two plates, each of the plates carrying at least one channel of a shape that complements at least part of the shape of the cross section of the wire, the plates being mounted facing each other so that the channels in the plates form at least one passageway in which said at least one wire is housed;
- a number of wires is housed in a number of passageways themselves delimited by a number of plates (11) which are stacked one upon the other to form at least one strand;
- the keys entirely cover the exterior surface of a portion of the strand;

- the transmitting device comprises at least one cylindrical sleeving in which said at least one wire is housed;
- said at least one wire is forced into said at least one sleeving;
- a number of sleevings are mounted adjacent to one another in the keys;
- the wires are made of a carbon-fiber-based composite; and
- the wires are solid wires.

BRIEF DESCRIPTION OF THE DRAWINGS

Other features and advantages of the invention will emerge during the detailed description which follows of two of its embodiments which are given by way of nonlimiting examples with reference to the appended drawings in which:

FIG. 5 is a perspective view of a second embodiment of one of the connecting systems of FIG. 1 according to the present invention; and FIG. 6 is a view in longitudinal section of the system of FIG. 5.

DESCRIPTION OF PREFERRED EMBODIMENT

Figure 1:
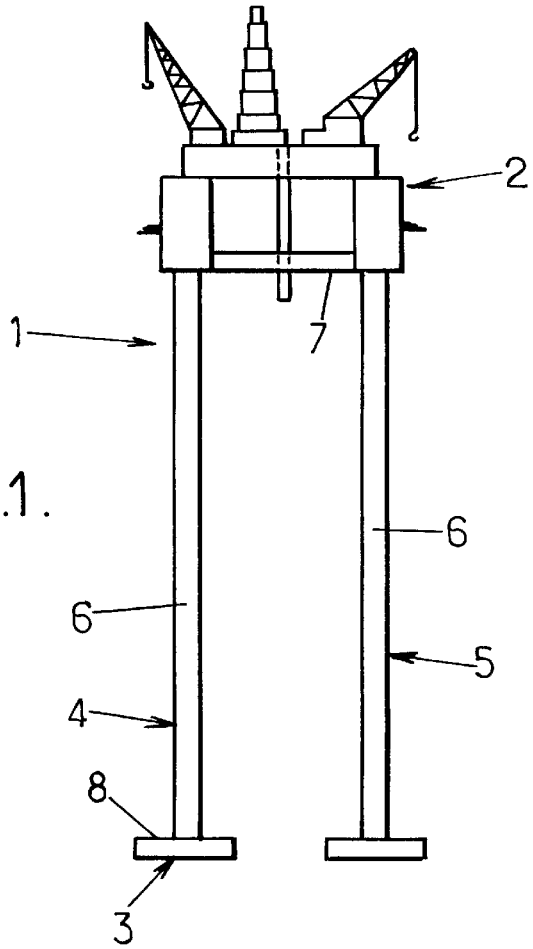
FIG. 1 is an overall schematic view of an offshore platform comprising cables anchored by connecting systems according to the present invention.

The building work structure 1 depicted in FIG. 1 and into which a number of connecting systems according to the present invention are incorporated adopts, for example, the form of an offshore platform. This platform in the conventional way comprises an upper part 2 which is generally located above sea level and which is anchored into the sea bed 3 by series 4, 5 of cables 6.

Each cable is tensioned between a constituent element 7 of the platform 1, for example beams of the upper part 2, and an anchoring block located on the sea bed 3, by means of connecting systems 10 which will be described hereinafter. Each cable is subjected to significant tensile loadings while at the same time having very good fatigue strength and exhibiting very good corrosion resistance.

Each cable 6 consists, in a way known per se, of a bundle of several strands which are themselves made up of a series of elementary wires 9. The reader will appreciate in what follows that each cable may be reduced to one strand or even one elementary wire.

Figure 4:
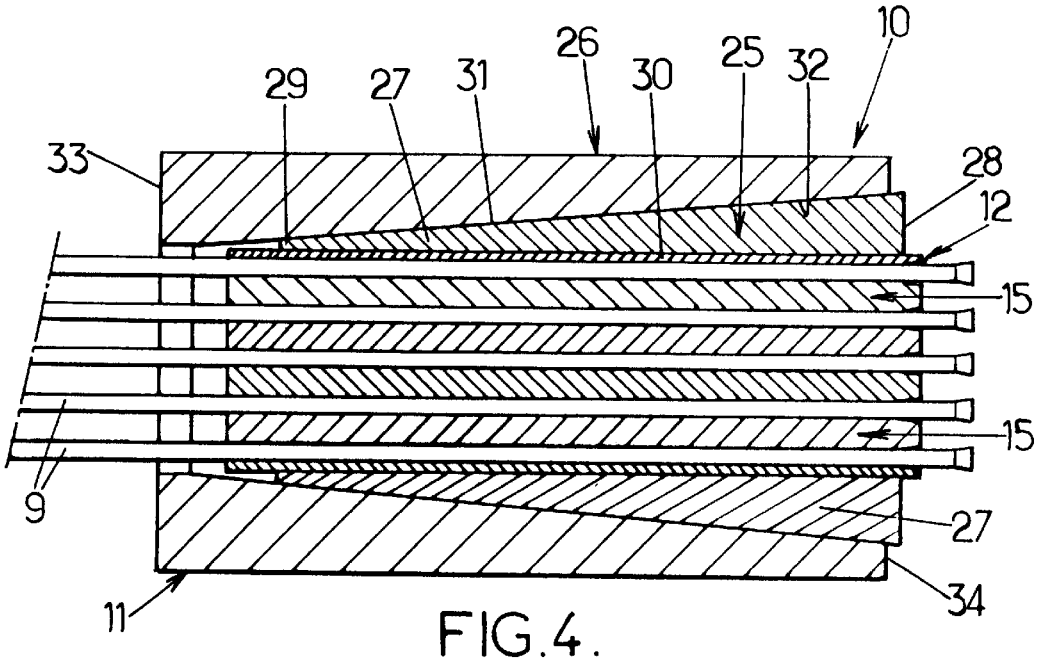
FIG. 4 is a view in longitudinal section of the system of FIG. 2.
Figure 2:
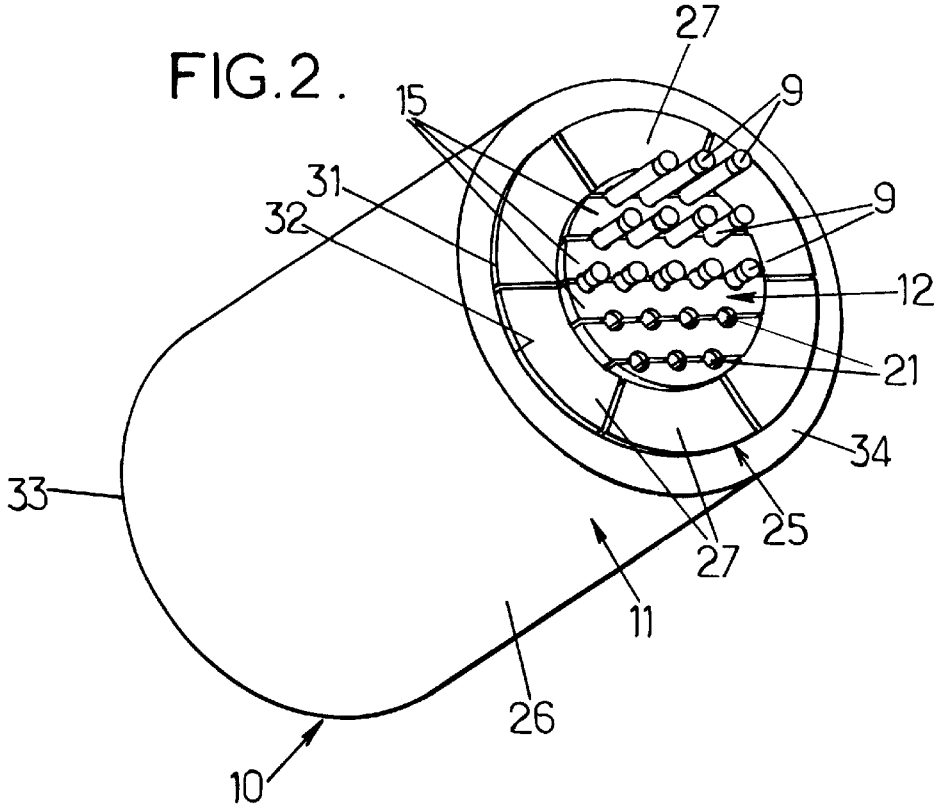
FIG. 2 is a perspective view of a first embodiment of one of the connecting systems of FIG 1 according to the present invention.
Figure 3:
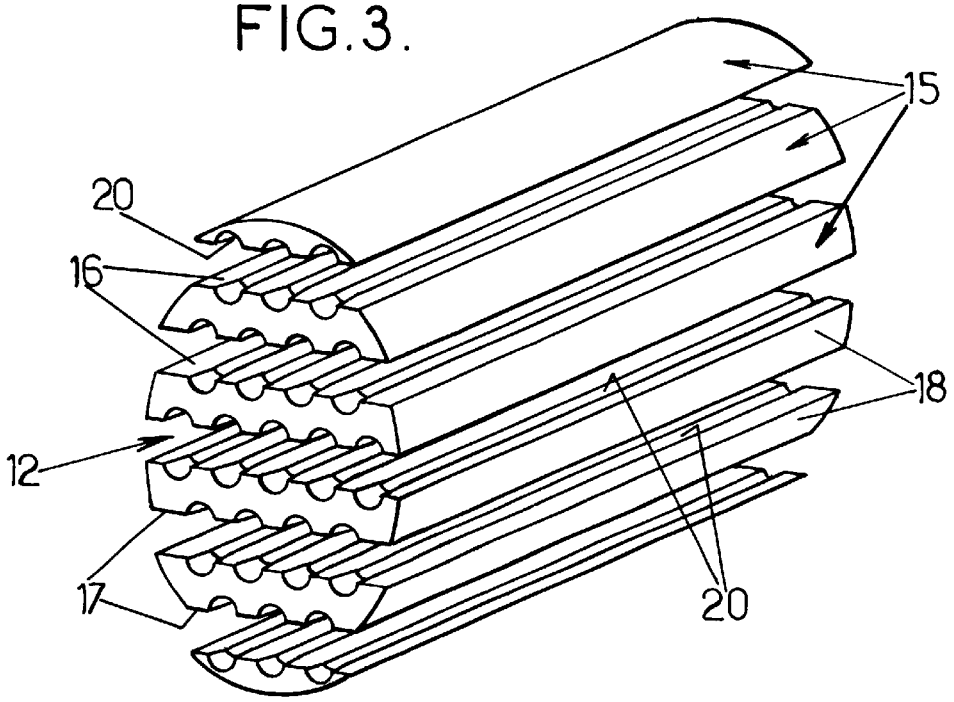
FIG. 3 is an exploded perspective view of just the plates of the system of FIG. 2.

As is more particularly visible in FIGS. 2 and 4, each strand consists of a collection of wires 9 which are, for example, mutually parallel at their ends. The strands thus formed may be combined with other strands to form the cable 6.

Each wire 9 is made of a metallic material or of a composite made up of unidirectional fibers embedded in a resin matrix. The unidirectional fibers are preferably made of carbon and may be high-strength fibers or high-modulus fibers which are embedded in a crosslinked epoxy matrix obtained, for example, by a pultrusion method.

Advantageously, the wires 9 are of cylindrical shape on a circular base and are solid wires. They may equally be of any other profile, such as a square or hexagonal profile.

The connecting system 10 according to the present invention comprises a clamping device 11 which is connected to the structure element 7 and a load transmitting device 12. This transmitting device is subjected to the clamping forces exerted uniformly by the clamping device 11 and transmits these forces to the wires 9 of the strand which are thus firmly clamped.

The transmitting device 12 consists, in the first embodiment, of a certain number of plates 15 between which the wires 9 are housed.

Each of the plates 15 is of roughly rectangular shape and has a top side 16, an underside 17 which is roughly flat, and longitudinal edges 18 which, taken along the thickness of the plate, are of curved shape so that the collection of plates 15, once superposed one on the other, form a cylinder on a circular base. Thus, each plate 15 forms a kind of longitudinal slide of a cylinder, which is thin in comparison with its length.

Each top side 16 and each underside 17 of the plates 15 has a channel 20. The cross section of the channels 20 is similar to half the cross section of the wires 9.

The channels 20 of a top side 16 of one plate 15 face the channels 20 of an underside 17 of the next plate 15. The channels 20 thus, in pairs, define passageways 21, the cross section of which complements that of the wires 9.

The plates 15 are made of a metallic material or of a composite or organic material.

The clamping device 11 consists of a jaw assembly 25 and of means 26 which in this instance adopt the form of a sleeve for compressing the jaw assembly 25.

The jaw assembly 25 has a number of keys 27. The collection of keys 27 defines a cylinder on an annular base having a proximal end 28 and a distal end 29. The inside diameter of this cylinder is similar to the diameter of the cylindrical stack of plates 15. The wall thickness at the proximal end 28 is greater than the wall thickness at the distal end 29. The proximal end is the end from which the ends of the wires 9 project, while the distal end is the end from which the wires run toward the rest of the building work.

Thus, each key 27 has an interior face 30 bearing against the plates 15 and an exterior face 31 that converges toward the interior face 30.

The sleeve 26 is a cylinder on an annular base, the interior wall 32 of which has a shape that complements that of the exterior wall of the cylinder defined by the keys 27. Thus, the sleeving 26 has a first end or distal end 33, the opening of which has a diameter smaller than the opening of the second end or proximal end 34 of this sleeving.

In consequence, the interior wall 32 of the sleeve is of frustoconical shape and complements the exterior shape, itself frustoconical, of the cylinder defined by the collection of keys 27. The diameter of the opening at the end 33 is slightly greater than the diameter of the cylinder defined by the stack of plates 15.

In order to produce the previously described connecting system 10, adhesive is applied to each of the channels 20 of the plates 15, then the wires 9 are set in place in these channels and the plates 15 are stacked one on the other. The stack thus produced is then inserted into the keys 27. The assembly is then slipped into the sleeve 26 via the proximal end 34, the opening of which has a large diameter. The keys 27 are compressed by a wedge effect between their exterior surface and the interior face of the sleeve 26 so that a predetermined clamping force is applied to the plates 15 and is transmitted to the wires 9. All that is then required is for the adhesive to dry.

The predetermined clamping force on the wires 9 is dependent on the slope of each of the inclined faces of the keys and of the sleeve and on the force with which the keys 27 are inserted into the sleeve 26.

Thus, each wire 9 of a strand is firmly anchored to withstand, for example, tensile forces.

In the embodiment previously described, the plates 15 of the load transmitting device occupy the entire interior volume of the cylinder defined by the keys 27.

In the second embodiment depicted in FIGS. 5 and 6, the connection system 50 differs from the previously described one only in the form of the load transmitting device 52, the other constituent elements are similar and bear identical numeral references.

The transmitting device 52 no longer occupies the entire interior volume of the cylinder defined by the keys 27 of the jaw assembly 25. This device consists of a number of metal sleevings 55, for example made of aluminum. The sleevings 55 are of an inside diameter roughly identical to the diameter of the wires 9 so that these wires are forced into the sleevings. The outside diameter of the sleevings is small by comparison with the inside diameter of the cylinder delimited by the keys 27.

The wires 9 are also bonded into the sleevings 55. These sleevings are made of a material with a low elastic limit, possessing a certain plasticity.

The way in which the connecting system 50 is mounted is roughly identical to the way in which the system of the first embodiment is mounted. The sleevings 55 are tangential to one another inside the keys, each of the sleevings 55 being in contact with the adjacent sleevings or with a key on three generatrices. In fact, at the time of clamping, the sleevings are crushed slightly so that each sleeving is in contact on three surfaces. Only some of them, the peripheral sleevings, are in contact with the keys.

As an alternative, the sleevings may be bonded together, filling the gaps between the sleevings.

In yet another alternative, the sleevings 55 have, in cross section, an exterior shape which is not circular but similar to a, diamond or some other shape, so that the sleevings can easily be juxtaposed.

What is claimed is:

1. Connecting system for connecting a cable for a building work structure and an element of the structure, the cable comprising at least one wire, the connecting system comprising:

a clamping device which is connected to the element; and a load-transmitting device which transmits a clamping load of the clamping device to the cable and which houses said at least one wire of the cable, said at least one wire being bonded into the load transmitting device.

2. Connecting system according to claim 1, wherein the clamping device comprises at least two keys of a jaw assembly, which bear against the load transmitting device and a compressing means for compressing the jaw assembly.

3. Connecting system according to claim 2, wherein the compressing means comprises a sleeve having an interior wall which converges toward one end of the sleeve, the keys of the jaw assembly being of a shape that complements that of said interior wall and being mounted in the sleeve so that the keys can be clamped in the sleeve by a wedge effect.

4. Connecting system according to claim 3, wherein the keys have an approximately triangular longitudinal cross section.

5. Connecting system according to claim 4, wherein the transmitting device comprises at least two plates, each of the plates carrying at least one channel of a shape that complements at least a portion of a shape of a cross section of the wire, the plates being mounted facing each other so that the channels in the plates form at least one passageway in which said at least one wire is housed.

6. Connecting system according to claim 5, wherein a number of wires are housed in a number of passageways themselves delimited by a number of plates which are stacked one upon the other to form at least one strand.

7. Connecting system according to claim 6, wherein the keys entirely cover an exterior surface of a portion of the strand.

8. Connecting system according to claim 4, wherein the transmitting device comprises at least one cylindrical sleeving in which said at least one wire is housed.

9. Connecting system according to claim 8, wherein said at least one wire is forced into said at least one sleeving.

10. Connecting system according to claim 9, wherein a number of sleevings are mounted adjacent to one another in the keys.

11. Connecting system according to claim 4, wherein the wires are made of a carbon-fiber-based composite.

12. Connecting system according to claim 4, wherein the wires are solid wires.

* * * * *